US011306962B2

(12) United States Patent
Yoo et al.

(10) Patent No.: US 11,306,962 B2
(45) Date of Patent: Apr. 19, 2022

(54) REFRIGERATOR

(71) Applicant: LG ELECTRONICS INC., Seoul (KR)

(72) Inventors: Daehyun Yoo, Seoul (KR); Kihyun Park, Seoul (KR); Kiyoung Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 174 days.

(21) Appl. No.: 16/295,484

(22) Filed: Mar. 7, 2019

(65) Prior Publication Data

US 2019/0277555 A1 Sep. 12, 2019

(30) Foreign Application Priority Data

Mar. 9, 2018 (KR) ..... 10-2018-0028046

(51) Int. Cl.

| | |
|---|---|
| ***F25B 21/00*** | (2006.01) |
| ***F25D 23/00*** | (2006.01) |
| ***F25B 21/02*** | (2006.01) |
| ***F25D 15/00*** | (2006.01) |

(Continued)

(52) U.S. Cl.

CPC ..... *F25D 23/006* (2013.01); *F25B 21/02* (2013.01); *F25D 15/00* (2013.01); *F25D 17/02* (2013.01); *F25D 23/003* (2013.01); *F28D 15/0275* (2013.01); *F25B 2321/023* (2013.01); *F25B 2321/0211* (2013.01); *F25B 2321/0252* (2013.01)

(58) Field of Classification Search

CPC ..... F25B 21/02; F25B 2321/02; F25B 2321/023; F25B 23/003

See application file for complete search history.

(56) References Cited

U.S. PATENT DOCUMENTS 4,738,113 A * 4/1988 Rudick ..... F25B 21/02 62/3.5
7,168,920 B2 * 1/2007 Liu ..... F04D 25/0613 415/220

(Continued)

FOREIGN PATENT DOCUMENTS

| | | |
|---|---|---|
| CN | 206817875 | 12/2017 |
| KR | 10-1323876 | 10/2013 |

(Continued)

OTHER PUBLICATIONS

"Shanglong Zhang and Julian A. Norato, Optimal Design of Panel Reinforcements With Ribs Made of Plates, Aug. 2017, Journal of Mechanical Design, vol. 139 / 081403-11" (Year: 2017).*

(Continued)

*Primary Examiner* — Brian M King

(74) *Attorney, Agent, or Firm* — Fish & Richardson P.C.

(57) ABSTRACT

A refrigerator includes an inner casing that defines a storage chamber and a cooling passage, a middle plate that is disposed outside the inner casing and that defines a foam space between the middle plate and the inner casing to accommodate a thermal-insulating material, an installation bracket that is fixed to the middle plate and that contacts the inner casing, a thermoelectric module mounted on the installation bracket and outside the foam space, and a fan assembly that is installed on the inner casing in the storage chamber and that includes a cooling fan.

20 Claims, 16 Drawing Sheets

(51) Int. Cl.
*F25D 17/02* (2006.01)
*F28D 15/02* (2006.01)

(56) References Cited

U.S. PATENT DOCUMENTS

| | | | | |
|---|---|---|---|---|
| 7,278,270 | B2 * | 10/2007 | Culp | F25B 21/02 136/203 |
| 8,468,836 | B2 * | 6/2013 | Tuszkiewicz | F25D 21/14 62/3.3 |
| 2007/0119186 | A1 | 5/2007 | Kitchens et al. | |
| 2007/0119187 | A1 | 5/2007 | Kitchens et al. | |
| 2018/0320954 | A1 * | 11/2018 | Wu | F25D 23/126 |

FOREIGN PATENT DOCUMENTS

| | | | | |
|---|---|---|---|---|
| KR | 101323876 | B1 * | 10/2013 | F25D 19/00 |
| WO | WO1995019533 | | 7/1995 | |

OTHER PUBLICATIONS

Translated of KR101323876B1 (Year: 2013).*
"Shanglong Zhang and Julian A. Norato, Optimal Design of Panel Reinforcements With Ribs Made of Plates, Aug. 2017, Journal of Mechanical Design, vol. 139 / 081403-11" (Year: 2017) (Year: 2017).*
Extended European Search Report in European Application No. 19155206.6, dated Jul. 23, 2019, 7 pages.
Office Action in European Appln. No. 19155206.6, dated Jun. 28, 2021, 5 pages.

* cited by examiner

REFRIGERATOR

CROSS-REFERENCE TO RELATED APPLICATION

This application is based on and claims the benefit of priority to Korean Patent Application No. 10-2018-0028046, filed on Mar. 9, 2018, in the Korean Intellectual Property Office, the disclosure of which is incorporated herein in its entirety by reference.

BACKGROUND

1. Technical Field

The present disclosure relates to a refrigerator.

2. Description of the Related Art

Generally, a refrigerator is a household appliance that can store objects, such as food, in a low-temperature state in the storage chamber of a cabinet. Because the storage chamber is enclosed by an insulating wall, the interior of the storage chamber may be maintained at a temperature lower than the external temperature.

Depending on the temperature zone of the storage chamber, the storage chamber may be divided into a refrigerating chamber or freezing chamber. The user may store the food in the freezing room or the refrigerating room depending on the type and condition of the food.

The refrigerator may be provided in a built-in type together with other appliances in the kitchen. In this case, the appearance design of the refrigerator is configured to match the kitchen furniture.

In recent years, depending on the various needs of the user, the refrigerator is placed in a living room or a room, not a kitchen. In other words, the installation position of the refrigerator is various.

As the location of the refrigerator varies, the appearance of the refrigerator is configured so that the appearance of the refrigerator goes well with the furniture in the space to install the refrigerator.

Korean Patent No. 10-1323876 discloses a cooling package with a thermoelectric element, and a refrigerator employing the same.

SUMMARY

The present embodiment provides a refrigerator in which a cooling device can easily be mounted from the outside even after a thermal-insulating material is formed therein.

In addition, the present embodiment provides a refrigerator in which a frame accommodating a thermoelectric element is prevented from deforming during engagement of a cooling device.

In addition, the present embodiment provides a refrigerator in which a storage chamber is prevented from communicating with a cooling passage.

In one aspect, a refrigerator may include an inner casing having a storage chamber defined therein; a passage forming portion provided on the inner casing to define a cooling passage; a middle plate disposed outside the inner casing, wherein a foam space is defined between the middle plate and the inner casing to accommodate a thermal-insulating material; an installation bracket fixed to the middle plate and contacting an end of the passage forming portion; a thermoelectric module mounted on the installation bracket and outside the foam space, wherein thermoelectric module has a thermoelectric element; and a fan assembly installed on the inner casing in the storage chamber and having a cooling fan.

DETAILED DESCRIPTIONS

Figure 1:
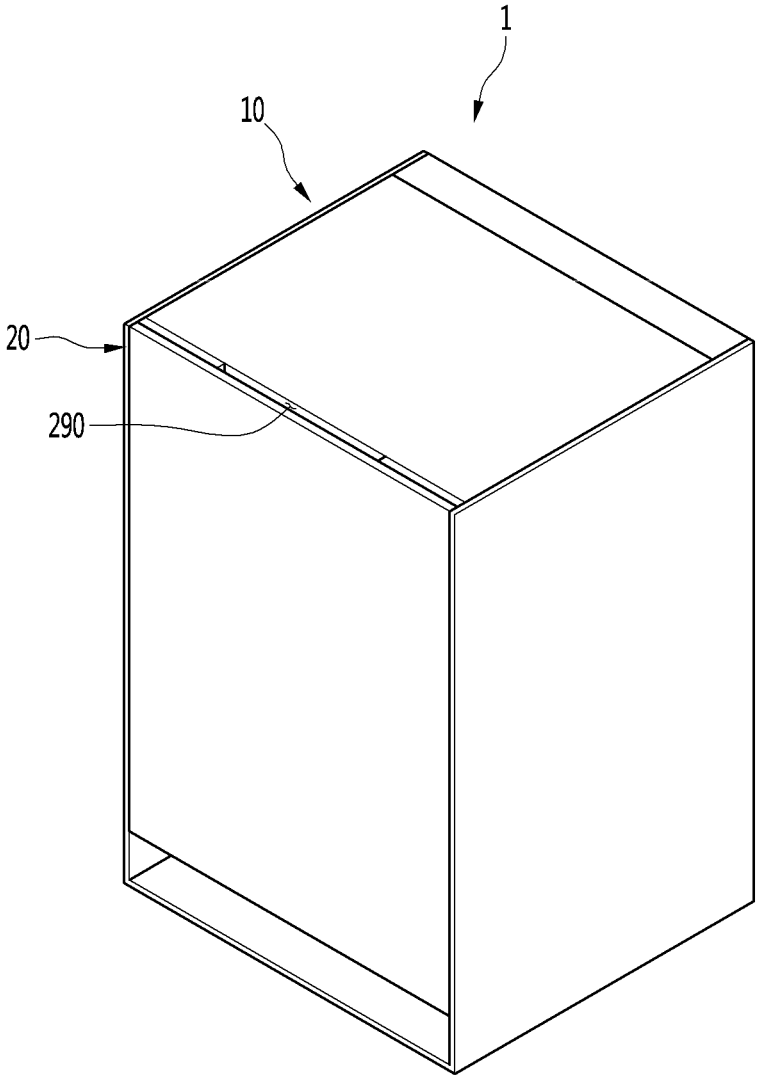
FIG. 1 is a perspective view of a refrigerator according to one embodiment of the present disclosure.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
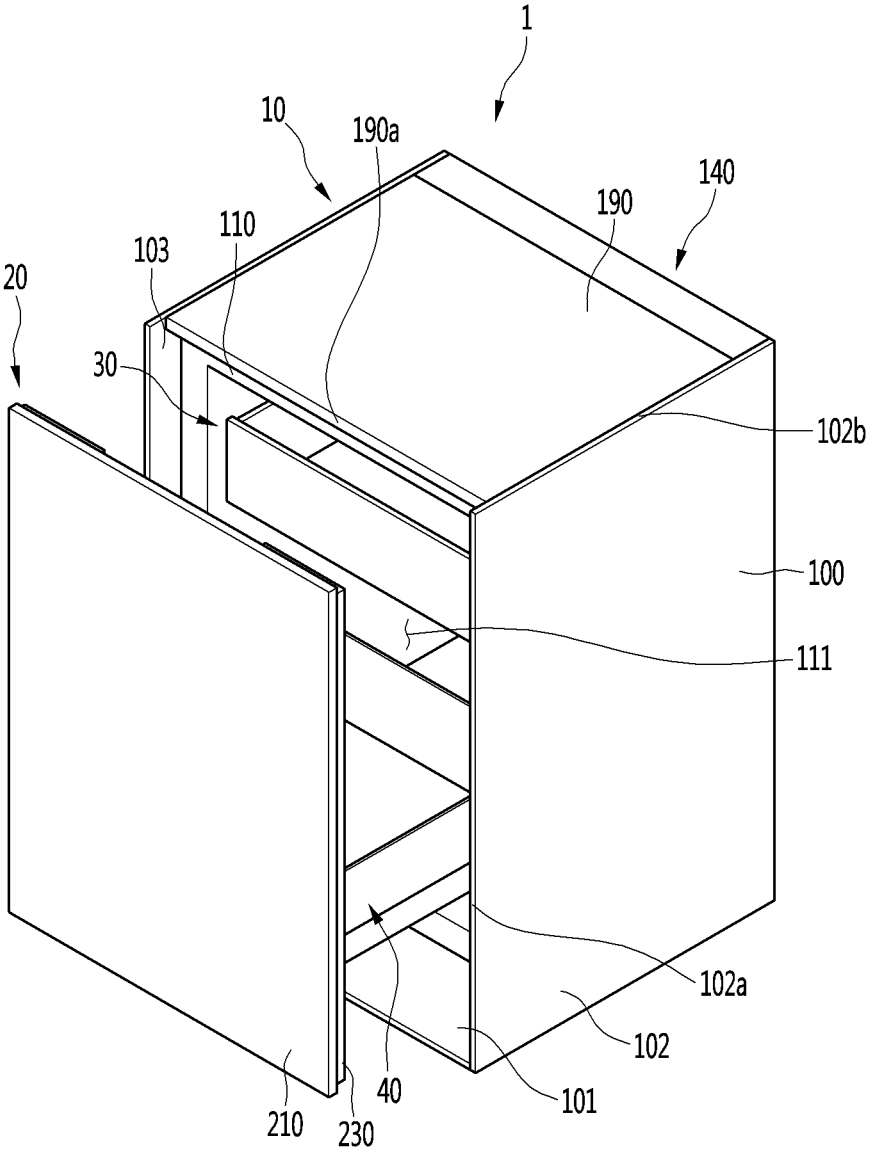
FIG. 2 is a perspective view showing a door being opened in FIG. 1.
Figure 3:
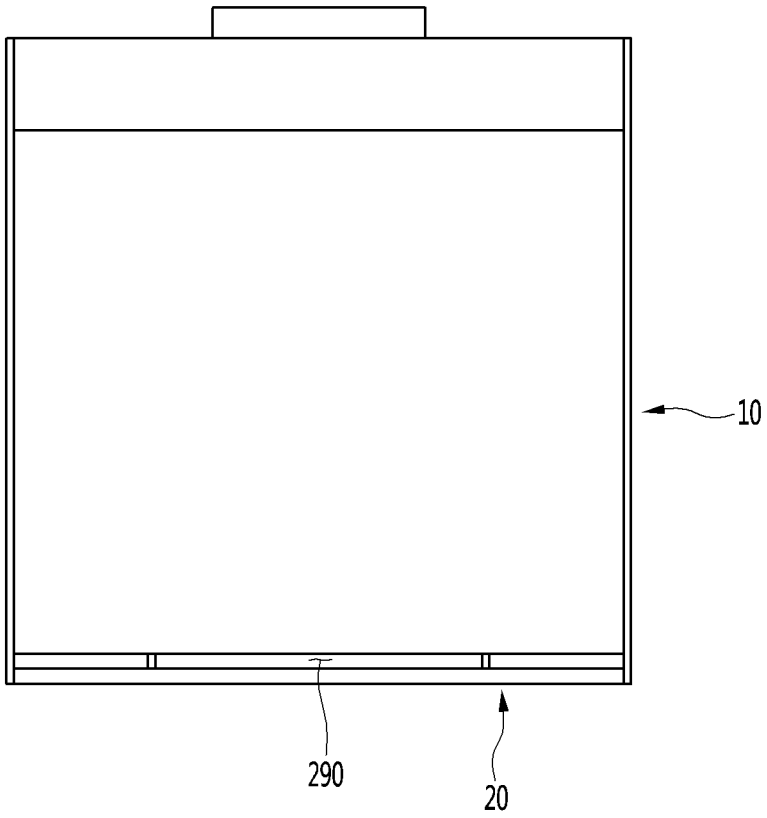
FIG. 3 is a plan view of the refrigerator of FIG. 1.

FIG. 1 is a perspective view of a refrigerator according to one embodiment of the present disclosure. FIG. 2 is a perspective view showing a door being opened in FIG. 1. FIG. 3 is a plan view of the refrigerator of FIG. 1.

Referring to FIGS. 1 to 3, a refrigerator 1 according to one embodiment of the present disclosure may include a cabinet 10 having a storage chamber 111, a door 20, which opens and closes the storage chamber 111, and connected to the cabinet 10.

The cabinet 10 may include the inner casing 110 forming the storage chamber 111, and an outer casing 100 surrounding the inner casing 110.

The outer casing 100 may be formed of a metal material. For example, the outer casing 100 may be formed of aluminum Al. The outer casing 100 may be formed by bending a plate at least twice. Alternatively, the outer casing 100 may be formed by joining a plurality of metal plates.

In one example, the outer casing 100 may include a pair of side panels 102 and 103.

The inner casing 110 may be directly or indirectly fixed to the outer casing 100 with the inner casing 110 being positioned between the pair of side panels 102 and 103.

A front end 102*a* of each of the pair of side panels 102 and 103 may be located more forwards than the front surface of the inner casing 110. The horizontal width of the door 20 may be equal to or less than the distance between the side panels 102 and 103.

Thus, a space in which the door 20 may be located may be defined between the pair of side panels 102 and 103.

In one example, the door 20 may be located between the pair of side panels 102 and 103 with the storage chamber 111 being closed by the door.

In this connection, the front surface of the door 20 may be coplanar with a front end 102*a* of each of the side panels 102 and 103 such that a step between the door 20 and the cabinet 10 may not occur when the storage chamber 111 is closed by the door.

That is, the front surface of the door 20 and a front end 102*a* of each of the side panels 102 and 103 may together define the appearance of the front surface of the refrigerator 1.

The door 20 may include a front panel 210 and a door liner 230 coupled to a rear surface of the front panel 210.

The front panel 210 may be formed of a wood material. However, the present disclosure is not limited thereto.

In one example, the front panel 210 and the door liner 230 may be engaged with each other by fasteners such as screws. The front panel 210 and the door liner 230 form a foam space therebetween. When the foam liquid is filled in the foam space, a thermal-insulating material may be formed between the front panel 210 and the door liner 230.

The door 20 may have a gripping space 290 in which a user's hand may be inserted so that the user can catch the door 20 to open the door 20.

In one example, the gripping space 290 may be formed by partially recessing an upper portion of the door liner 230 downwardly.

While the door 20 closes the storage chamber 111, the gripping space 290 may be located between the front panel 210 and the cabinet 10. Thus, while the door 20 closes the storage chamber 111, the user may open the door 20 by inserting a hand into the gripping space 290 and then pulling the door 20.

In the present embodiment, since while the door 20 is closed, a structure such as a handle does not protrude outward, there is an advantage that the beauty of refrigerator 1 is improved.

The height of the refrigerator 1 may be lower than a typical adult height. The present disclosure may not be limited thereto. The lower the capacity of the refrigerator 1, the lower the height of the refrigerator 1.

As in the present embodiment, when there is a gripping space 290 within the top of the door 20, the following advantage is achieved: Even though the height of the refrigerator 1 is low, the user can easily open the door 20 while the user is standing or sitting.

In one embodiment, the top end 102*b* of each of the pair of side panels 102 and 103 may be higher than the top of the inner casing 110.

Therefore, a space may be formed above the inner casing 110. A cabinet cover 190 may be located in the space. The cabinet cover 190 may form a top appearance of the cabinet 10. That is, the cabinet cover 190 forms a top appearance of the refrigerator 1.

The cabinet cover 190 may be secured directly to the inner casing 110 or to the middle plate 150 surrounding the inner casing 110.

While the cabinet cover 190 covers the inner casing 110, the cabinet cover 190 may be located between the pair of side panels 102 and 103.

In one embodiment, in order to avoid a step between the cabinet cover 190 and the cabinet 10, a top surface of the cabinet cover 190 may be located on the same plane or the same height as the top end 102*b* of each of the side panels 102 and 103.

In one example, the cabinet cover 190 may be formed of wood material. The present disclosure is not so limited.

That is, the front panel 210 and the cabinet cover 190 may be formed of the same material.

In the present embodiment, the front panel 210 of the door 20 and the cabinet cover 190 are both formed of a wood material. Thus, there is an advantage that the aesthetics can be improved due to the material identity between the door 20 and the cabinet cover 190 while the door 20 is closed.

Further, when the height of the refrigerator 1 is low, the user can visually check the cabinet cover 190. In this connection, since the cabinet cover 190 is made of the wood material, this has the advantage of not only improving the basic aesthetics but also achieving aesthetic harmony with the surrounding furniture where the refrigerator 1 is positioned.

In one example, the refrigerator 1 of the present embodiment may be implemented as a refrigerator that can be used as a table (hereinafter, a table type refrigerator).

A refrigerator that can be used as a table may also serve as a table function in addition to the storage function of foods. Unlike conventional refrigerators, which are often found in the kitchen, a refrigerator, which can be used as a table, may be placed next to the bedroom bed and may be used. In the present embodiment, since the cabinet cover 190 and the front panel 210 are formed of wood material, the appearance of the refrigerator may be in harmony with the surrounding furniture when the refrigerator 1 is placed next to the bedroom.

In one example, for the convenience of the user, the height of the table type refrigerator is preferably similar to the height of the bed. The height of the table type refrigerator may be smaller than the height of a conventional refrigerator and thus the refrigerator may be formed compactly.

A front surface 190*a* of the cabinet cover 190 may be located more forwards than the front surface of the inner casing 110. Thus, while the door 20 closes the storage chamber 111, the cabinet cover 190 may cover a portion of the door liner 230 from above.

The refrigerator 1 may further include one or more drawer assemblies 30 and 40 received in the storage chamber 111.

A plurality of drawer assemblies 30 and 40 may be provided in the storage chamber 111 for efficient storage space.

The multiple drawer assemblies 30 and 40 may include upper drawer assembly 30 and lower drawer assembly 40. In some cases, the upper drawer assembly 30 may be omitted.

The door 20 may open and close the storage chamber 111 while sliding in a forward and backward direction.

In the present embodiment, even when the refrigerator 1 is placed in a narrow space such as a kitchen, living room, or room, the user has the advantage that the door 20 can be opened without interfering with the surrounding structure since the door 20 opens and closes the storage chamber 111 in the sliding manner.

In order that the door 20 is slid in and out, the refrigerator 1 may also include a rail assembly (not shown).

The rail assembly (not shown) may be connected to the door 20 on one side of the rail assembly, and to the lower drawer assembly 40 on the other side of the rail assembly.

Figure 4:
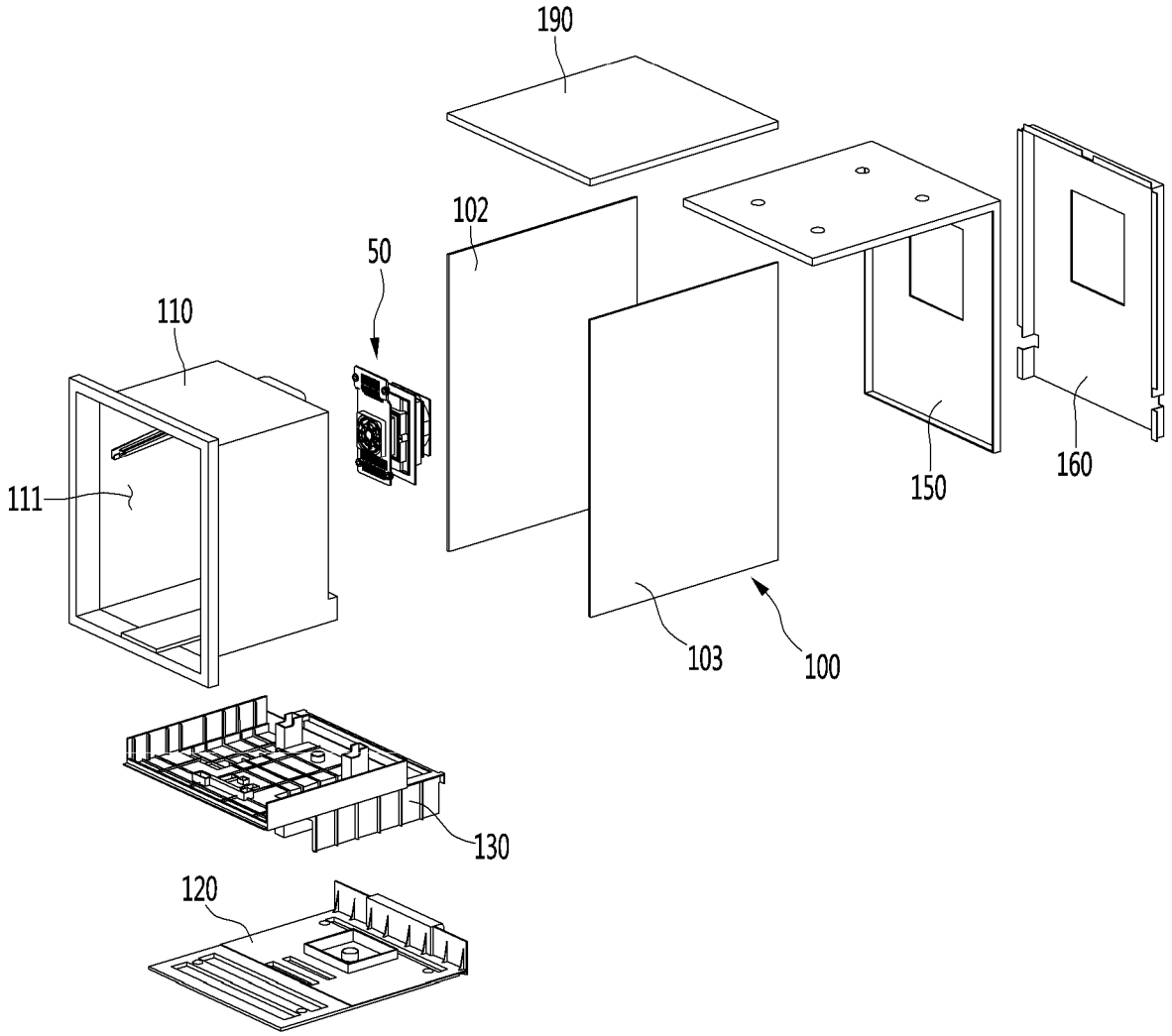
FIG. 4 is an exploded perspective view of a cabinet according to one embodiment of the present disclosure.

FIG. 4 is an exploded perspective view of the cabinet according to one embodiment of the present disclosure.

Referring to FIGS. 1 to 4, a cabinet 10 according to one embodiment of the present disclosure may include an outer casing 100, an inner casing 110, and a cabinet cover 190.

The outer casing 100 may include a pair of side panels 102 and 103. The pair of side panels 102, 102 may form the side appearance of the refrigerator 1.

The outer casing 100 may further include a rear panel 160 that forms the rear surface appearance of the refrigerator 1.

Thus, the appearance of the refrigerator 1 except the door 20 may be formed by the side panels 102 and 103, the cabinet cover 190 and the rear panel 160.

The cabinet 10 may further include a casing supporter 130 supporting the inner casing 110 and a base 120 coupled to the bottom of the casing supporter 130.

The cabinet 10 may also include a middle plate 150. The middle plate, together with the inner casing 110, forms a foam space. The middle plate 150 may cover the top and rear surfaces of the inner casing 110 at a spaced apart position from the inner casing 110.

A display unit 140 may be coupled to at least one of the middle plate 150 and the side panels 102 and 103.

The cabinet 10 may further include a cooling device 50 for cooling the storage chamber 111.

The cooling device 50 may include a thermoelectric element, and the refrigerator size may be reduced by a thermoelectric element.

The foam space may be formed by the inner casing 110, the side panels 102 and 103, the casing supporter 130 and the middle plate 150. A foam liquid may be filled in the foam space to form a thermal-insulating material.

Figure 5:
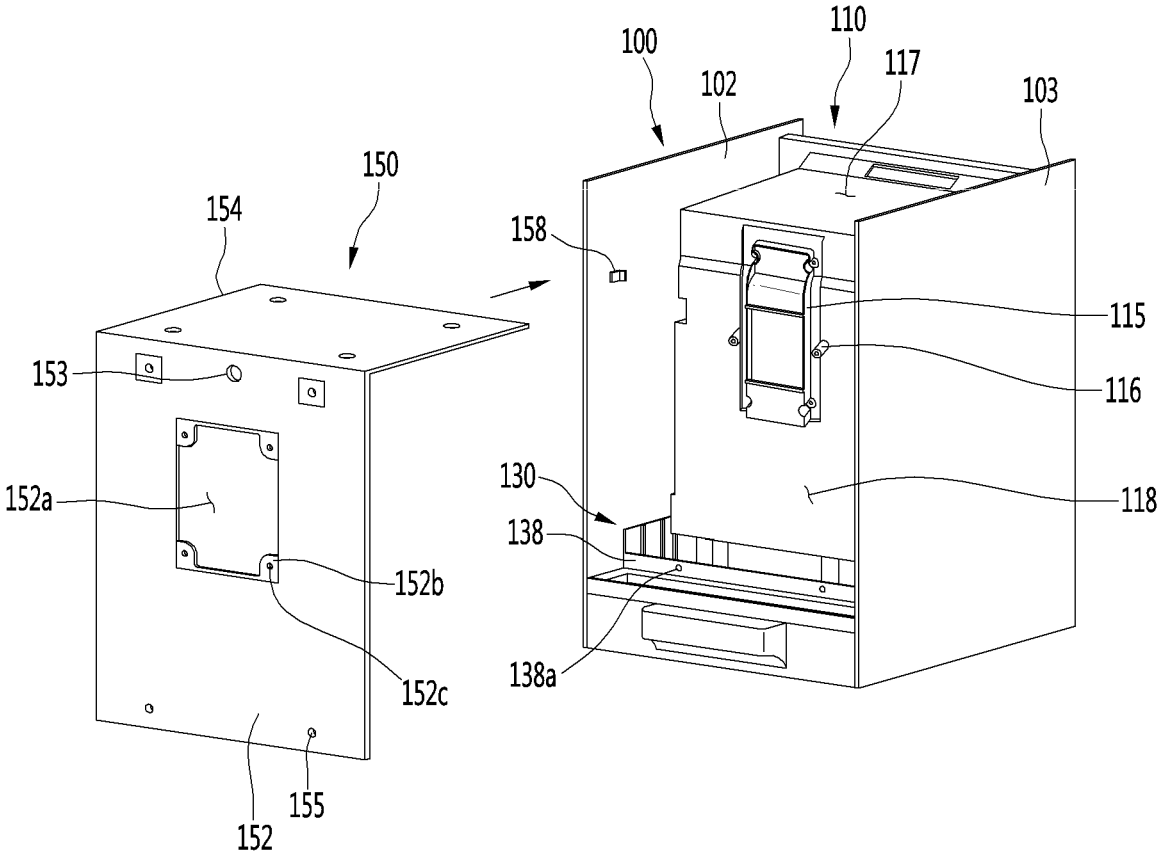
FIG. 5 shows a state before a middle plate is assembled according to one embodiment of the present disclosure.
Figure 6:
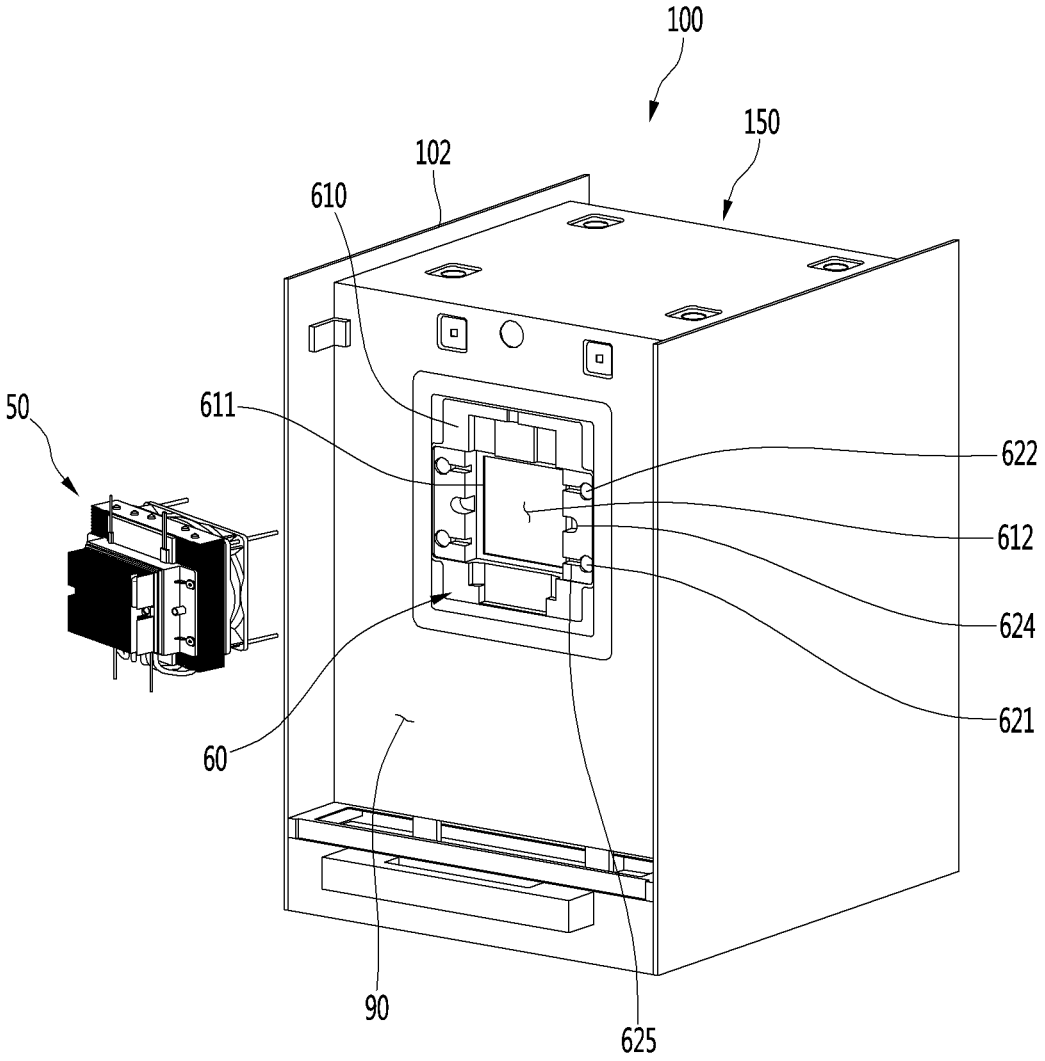
FIG. 6 shows a state in which the middle plate has been assembled according to one embodiment of the present disclosure.
Figure 7:
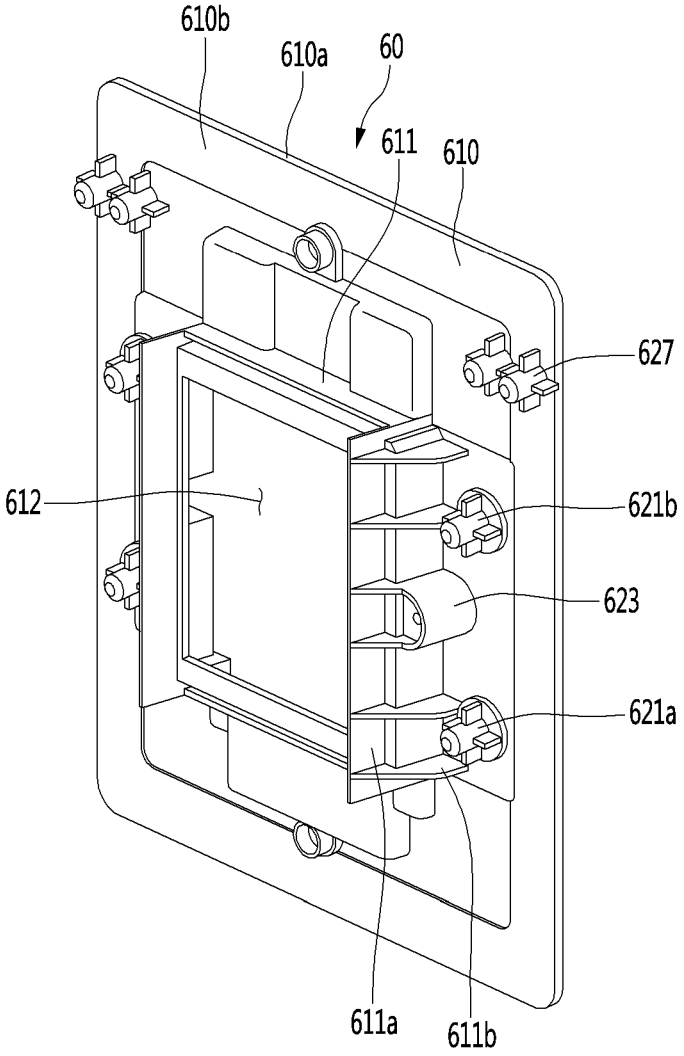
FIG. 7 is a perspective view of an installation bracket according to one embodiment of the present disclosure.

FIG. 5 shows a state before a middle plate is assembled according to one embodiment of the present disclosure. FIG. 6 shows a state in which the middle plate has been assembled according to one embodiment of the present disclosure. FIG. 7 is a perspective view of an installation bracket according to one embodiment of the present disclosure.

Referring to FIGS. 5 to 7, the middle plate 150 may cover the inner casing 110 at the rear of the inner casing 110.

The middle plate 150 may include a rear plate 152 covering a rear surface of the inner casing 110 and an upper plate 154 covering a top surface of the inner casing 110.

The upper plate 154 may extend horizontally from the top of the rear plate 152. Accordingly, the middle plate 150 may be formed in the form of an inverted L shape.

The upper plate 154 may be seated on the front surface top of the inner casing 110. In one example, the upper plate 154 may be attached to the front surface top of the inner casing 110 by adhesive means.

While the upper plate 154 is seated on the front surface top of the inner casing 110, the upper plate 154 may be spaced apart from a top surface of the inner casing 110. Thus, a foam space 117 may be defined between the upper plate 154 and a top surface of the inner casing 110.

The rear plate 152 may be coupled to the casing supporter 130. The casing supporter 130 may have a plate engagement rib 138.

In each of the plate engagement ribs 138 and the rear plate 152, engagement holes 138*a* and 155 for bolt engagement may be formed.

While the rear plate 152 is in contact with the rear surface of the plate engagement rib 138, the rear plate 152 may be engaged with the plate engagement rib 138 by bolts.

In this connection, while the installation bracket 60 is engaged with the rear plate 152 between the rear plate 152 and the rear surface of the inner casing 110, the middle plate 150 may be assembled.

The rear plate 152 may be spaced apart from the rear surface of the inner casing 110. Thus, the foam space 118 may be defined between the rear plate 152 and the rear surface of the inner casing 110.

A fixing bracket 158 may be fixed to the rear of the rear plate 152. The fixing brackets 158 may be secured to the respective side panels 102 and 103. Thus, the fixing bracket 158 not only fixes the rear plate 152 to the side panels 102 and 103, but also prevents deformation of the rear plate 152 during the filling of the foam liquid.

The rear plate 152 may be provided with an inlet 153 for injection of the foam liquid therethrough. The inlet 153 may be blocked by unillustrated packing.

The rear plate 152 may further include a through-hole 152*a* through which the cooling device 50 passes.

In a state in which the assembly of the middle plate 150 is completed, a top surface of the upper plate 154 may be positioned lower than top end 102*b* of the respective side panels 102 and 103. Thus, above the upper plate 154, there may be a space where the cabinet cover 190 may be located.

Furthermore, in a state in which the assembly of the middle plate 150 is completed, the rear surface of the rear plate 152 may be spaced forwards from the rear end 102*c* of the respective side panels 102 and 103. Thus, behind the rear plate 152, there may be a space through which the air for heat-dissipation of the cooling device 50 may flow.

The installation bracket 60 may include a plate-type installation plate 610. The installation plate 610 may be engaged with the rear plate 152 via the fastener such as a screw.

The installation plate 610 may include the first surface 610*a* and the second surface 610*b* facing the first surface 610*a*.

An engagement extension 152*b* for engagement of the installation bracket 60 may be formed in the through-hole 152*a* of the rear plate 152. An engagement hole 152*c* may be formed in the extension 152*b*.

The first surface 610*a* of the installation plate 610 may contact the extension 152*b*.

The installation plate 610 may include a receiving portion 611 for receiving a portion of the cooling device 50. In one example, the receiving portion 611 may be formed by a portion of the first surface 610*a* being recessed toward the second surface 610*b*. A portion of the receiving portion 611 may protrude from the second surface 610*b*.

In the bottom of the receiving portion 611, an opening 612 through which the cooling sink 530 to be described later passes may be formed.

The receiving portion 611 includes walls 611*a* surrounding the cooling sink 530 passing through the opening 612. At least one of the walls 611*a* may be formed to have a reinforcing rib 611*b*.

In the second surface 610*b* of the installation plate 610, an engagement boss 627 for engagement with the middle plate 150 may be formed. The engagement boss 627 may protrude from the second surface 610*b* in a direction away from the first surface 610*a*.

Moreover, in the second surface 610*b* of the installation plate 610, a plurality of the first engagement portions 621*a* and 621*b* for engagement with the cooling device 50 may be formed. The plurality of first engagement portions 621*a* and 621*b* may protrude from the second surface 610*b* in a direction away from the first surface 610*a*.

In one example, the plurality of the first engagement portions 621*a* and 621*b* may be disposed on both opposite sides of the opening 612, such that the engagement thereof with the cooling device 50 may be firm. In one example, the first engagement portions 621*a* and 621*b* may be disposed at the opposite sides of the opening 612 and may be spaced from each other in a vertical direction.

In the first surface 610*a* of the installation plate 610 and in the regions corresponding to the plurality of first engagement portions 621*a* and 621*b*, first protrusion receiving grooves 621 and 622 may be formed to accommodate first engagement protrusions 514 and 515 of the cooling device 50 to be described later respectively. Once the first engagement protrusions 514 and 515 are received within the first protrusion receiving grooves 621 and 622, the first engagement protrusions 514 and 515 are fixed. Thus, the screw may be easily engaged with the first engagement protrusions 514 and 515 and the first engagement portions 621*a* and 621*b*.

In the first surface 610*a* of the installation plate 610, a rib receiving groove 625 may be formed. The rib receiving groove 625 communicates the space in the receiving portion 611 with the respective first protrusion receiving grooves 621 and 622.

The installation plate 610 may further include second engagement portions 623 for engagement with the inner casing 110. The second engagement portions 623 may be formed on both opposite sides of the receiving portion 611, respectively.

The second engagement portion 623 may protrude from the second surface 610*b* of the installation plate 610. Further, the inner casing 110 may have a plate engagement boss 116 aligned with the second engagement portion 623. The plate engagement boss 116 may protrude from the rear surface of the inner casing 110.

In order to maximize the coupling between the inner casing 110 and the installation plate 610, the second engagement portion 623 may be positioned adjacent to a level bisecting the height of the installation plate 610.

In one example, the second engagement portion 623 may be located in a region corresponding to a region between a plurality of the first engagement portions 621*a* and 621*b*.

Further, the installation plate 610 may further include a second protrusion receiving groove 624 for receiving the second engagement protrusion 518 of the cooling device 50, which will be described later. The second protrusion receiving groove 624 may be aligned with the second engagement portion 623.

Figure 8:
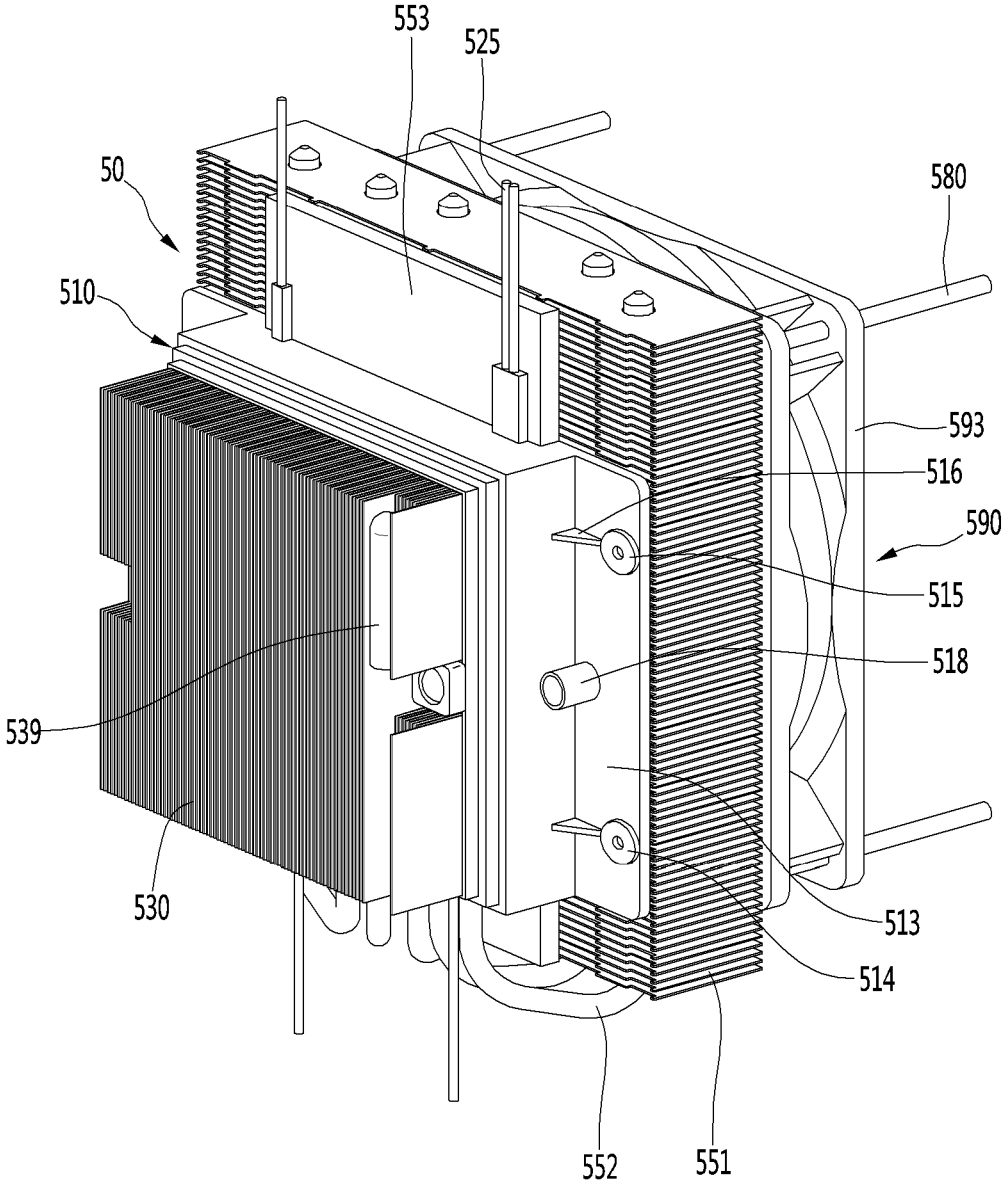
FIG. 8 is a perspective view of a cooling device according to one embodiment of the present disclosure.
Figure 9:
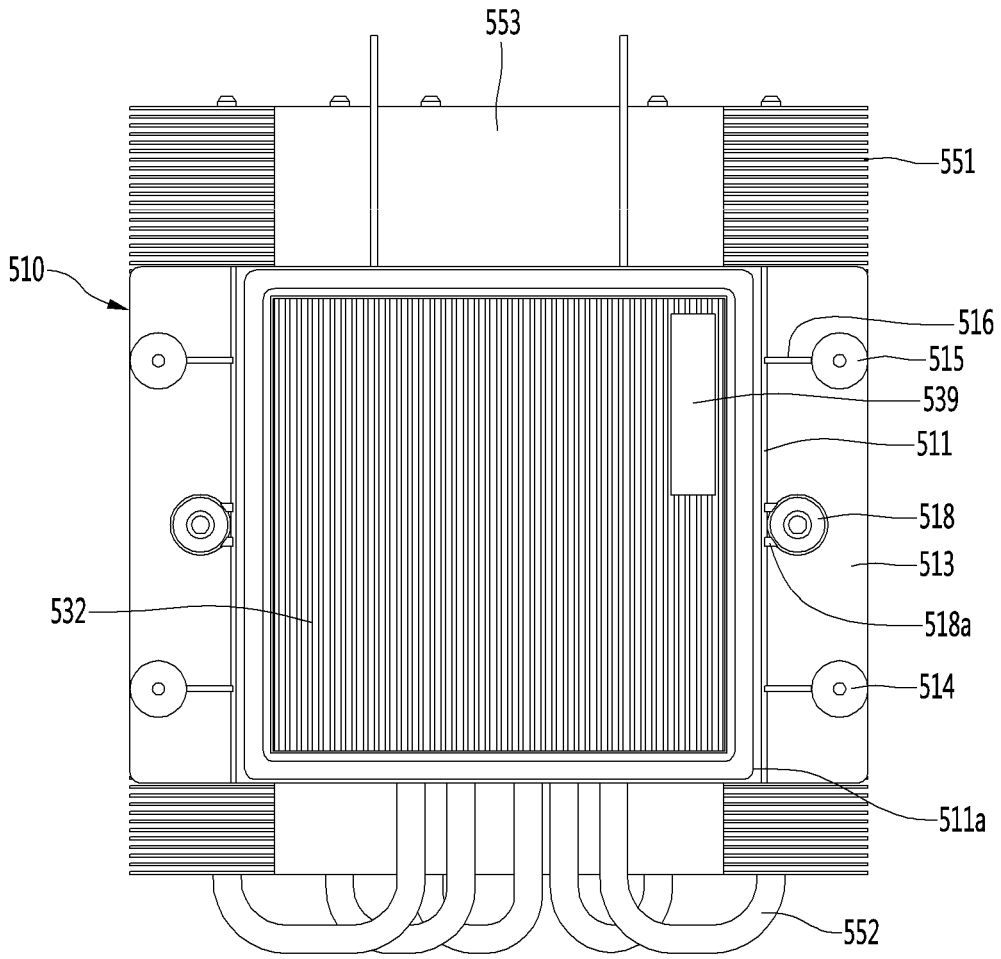
FIG. 9 is a view of the cooling device of FIG. 8 as viewed from a cooling sink.
Figure 10:
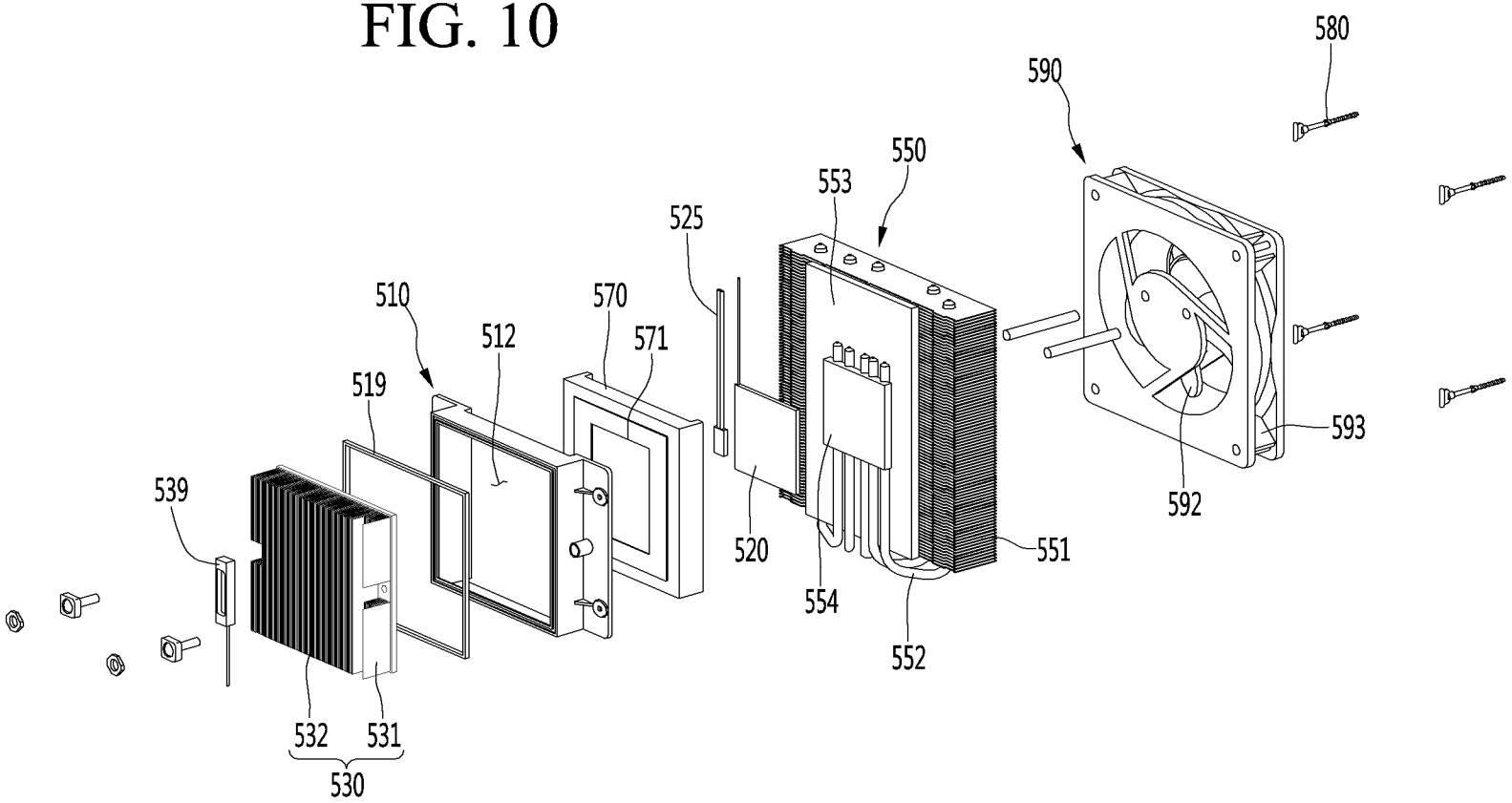
FIG. 10 and FIG. 11 are exploded perspective views of the cooling device of FIG. 8.
Figure 11:
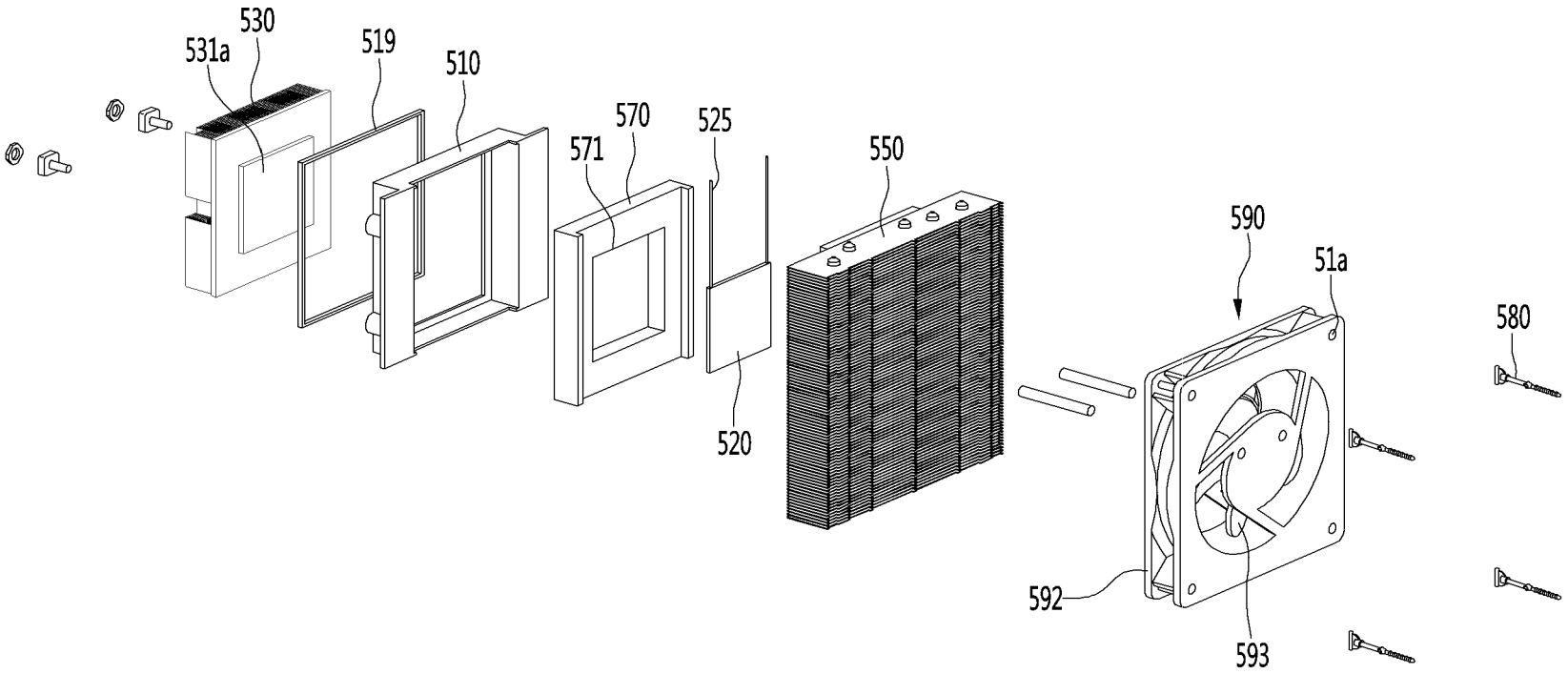

FIG. 8 is a perspective view of a cooling device according to one embodiment of the present disclosure. FIG. 9 shows the cooling device of FIG. 8 as viewed from the cooling sink, and FIG. 10 and FIG. 11 are exploded perspective views of the cooling device of FIG. 8.

Referring to FIG. 5, FIG. 8 to FIG. 11, the cooling device 50 may include a thermoelectric module. The thermoelectric module may include a thermoelectric element 520, a cooling sink 530, a heat sink 550, and a module frame 510.

The thermoelectric module may utilize the Peltier effect to keep the temperature of the storage chamber 111 low. The thermoelectric module 500 itself is a well-known technology, and thus the details of the operating principle of the module 500 will be omitted.

The cooling device 50 may pass through the middle plate 150 and may be disposed more forwards than the rear panel 160.

The thermoelectric element 520 may include a low-temperature portion and a high-temperature portion. The low-temperature portion and the high-temperature portion may be determined according to the direction of the voltage applied to the thermoelectric element 520. The low-temperature portion of the thermoelectric element 520 may be disposed closer to the inner casing 110 than the high-temperature portion.

The low-temperature portion may contact the cooling sink 530, while the high-temperature portion may contact the heat sink 550. The cooling sink 530 cools the storage chamber 111. In the heat sink 550, heat-dissipation may occur.

A fuse 525 may be connected to the thermoelectric element 520. Thus, when an overvoltage is applied to the thermoelectric element 520, the fuse 525 may also block the voltage applied to the thermoelectric element 520.

The cooling device 50 may include a cooling fan 750 for flowing air from the storage chamber 111 to the cooling sink 530 and a heat dissipation fan 590 for flowing external air to the heat sink 550.

The cooling fan 750 may be disposed in front of the cooling sink 530, while the heat-dissipation fan 590 may be disposed behind the heat sink 550.

The cooling fan 750 may be positioned to face the cooling sink 530, while the heat-dissipation fan 590 may be disposed to face the heat sink 550.

The cooling fan 750 may be disposed within the inner casing 110. The cooling fan 750 may be covered by a fan cover.

The cooling device 50 may further include a defrost sensor 539. The defrost sensor 539 may be disposed on the cooling sink 530.

The cooling device 50 may further include a thermal-insulating member 570 that surrounds the thermoelectric element 520. The thermoelectric element 520 may be located within the thermal-insulating member 570. The thermal-insulating member 570 may be provided with an element mounting hole 571 opened in the front-rear direction. The thermoelectric element 520 may be located within the element mounting hole 571.

The front-rear direction thickness of the thermal-insulating member 570 may be larger than the thickness of the thermoelectric element 571.

The thermal-insulating member 570 may prevent the heat of the thermoelectric element 520 from being conducted around the thermoelectric element 520, thereby enhancing the cooling efficiency of the thermoelectric element 520. The perimeter of the thermoelectric element 520 may be covered by the thermal-insulating member 570, so that the heat transmitted from the cooling sink 530 to the heat sink 550 may not spread to the surroundings.

The cooling sink 530 may be arranged to contact the thermoelectric element 520. The cooling sink 530 may be kept at a low temperature by contacting the low-temperature portion of the thermoelectric element 520.

The cooling sink 530 may include a cooling plate 531 and a cooling fin 532.

The cooling plate 531 may be disposed in contact with the thermoelectric element 520. At least a portion of the cooling plate 531 may be inserted into an element mounting hole 571 formed in the thermal-insulating member 570 to contact the thermoelectric element 520.

In one example, the cooling plate 531 may include a protrusion 531*a* protruding to be inserted into the element mounting hole 571.

The cooling plate 531 may contact the low-temperature portion of the thermoelectric element 520 to conduct cool air to the cooling fin 532.

The cooling fin 532 may be disposed in contact with the cooling plate 531. The cooling plate 531 may be located between the cooling fin 532 and the thermoelectric element 520. The cooling fin 532 may be located in front of the cooling plate 531.

The cooling fin 532 may be positioned within the storage chamber 111 through the inner casing 110.

The inner casing 110 may include a passage forming portion 115 forming a cooling passage 180. The cooling fin 532 may be located within the cooling passage 180. The cooling fin 532 may also heat-exchange with the air in the cooling passage 180 to cool the air. A plurality of cooling fins 532 may be in contact with the cooling plate 531 to increase the heat exchange area with the air. Each of the plurality of cooling fins 532 may extend in the vertical direction. The plurality of cooling fins 532 may be arranged to be spaced apart from each other in the horizontal direction.

The module frame 510 may include a box-shaped frame body 511.

In the frame body 511, a space 512 may be formed to accommodate the thermal-insulating member 570 or the thermoelectric element 520. Since the thermoelectric element 520 is accommodated in the thermal-insulating member 570, the thermoelectric element 520 may be located within the space 512.

The module frame 510 may be formed of a material that may minimize heat loss due to heat conduction. For example, the module frame 510 may have a nonmetallic material such as plastic. The module frame 510 may prevent the heat of the heat sink 550 from being conducted to the cooling sink 530.

A gasket 519 may be coupled to the front surface of the frame body 511. The gasket 519 may have an elastic material such as rubber. In one example, the gasket 519 may be formed in a rectangular ring shape, but the present disclosure is not limited thereto. The gasket 519 may also be a sealing member. A gasket groove 511*a* may be formed in the front surface of the frame body 511 to accommodate the gasket 519 therein.

The frame body 511 may be received in the receiving portion 611 of the installation plate 610. The frame body 511 may contact a wall 611*a* forming the receiving portion 611. Further, the gasket 519 coupled to the frame body 511 may be in contact with the bottom of the receiving portion 611. Accordingly, the gasket 519 may prevent the heat-dissipation passage 90 and the cooling passage 180 formed between the middle plate 150 and the rear panel 160 from communicating with each other.

The module frame 510 may further include an engagement plate 513 extending from the frame body 511. In one example, the engagement plates 513 may extend from both opposite sides of the frame body 511, respectively. The engagement plate 513 has a configuration for being coupled with the installation bracket 60.

In one example, the engagement plate 513 may have a plurality of the first engagement protrusions 514 and 515 for engagement with the plurality of first engagement portions 621*a* and 621*b*. The plurality of first engagement protrusions 514 and 515 may be spaced apart in a vertical direction.

In addition, the engagement plate 513 may further include a second engagement protrusion 518 for engagement with the second engagement portion 623.

To maximize the coupling between the inner casing 110 and the module frame 510 and the installation bracket 60, the second engagement protrusion 518 may be positioned adjacent to a level bisecting the height of the module frame 510.

In one example, the second engagement protrusion 518 may be positioned in a region corresponding to a region between the plurality of first engagement protrusions 514 and 515.

The fastener may engage the plate engagement boss 116, the second engagement portion 623, and the second engagement protrusion 518.

In order that the engagement force to be transmitted to the frame body 511 is minimized during the engagement of the fastener with the plurality of first engagement protrusions 514 and 515, the plurality of first engagement protrusions 514 and 515 may be located on the side end of the engagement plate 513 at a position farthest from the frame body 511 in the horizontal direction.

When an excessive engagement force is generated in the process of the fastener being engaged with the plurality of first engagement protrusions 514 and 515, the engagement plate 513 may be deformed. Thus, the deformation force of the engagement plate 513 may be transmitted to the frame body 511.

Then, the position of the frame body 511 relative to the bottom of the receiving portion 611 is changed. Thus, a portion of the gasket 519 may be spaced apart from the bottom of the receiving portion 611. In this case, there is a problem that the cooling passage 180 and the heat-dissipation passage 90 are communicated with each other such that the cold air of the storage chamber 111 leaks to the heat-dissipation passage 90.

Thus, in the present embodiment, it may be configured such that the plurality of first engagement protrusions 514 and 515 may be located on the side end of the engagement plate 513 at a position farthest from the frame body 511 in the horizontal direction.

In addition, in the present embodiment, in order that the deformation of the engagement plate 513 relative to the frame body 511 is minimized in the process of engaging the fastener with the plurality of first engagement protrusions 514 and 515, a connection rib 516 for connecting the frame body 511 and each of the first engagement protrusions 514 and 515 may protrude from the engagement plate 513.

The fastener engaged with the second engagement protrusion 518 is configured to maintain the gasket 519 of the frame body 511 to be in contact with the bottom of the receiving portion 611.

However, the frame body 511 should be prevented from being deformed via the engagement force of the second engagement protrusion 518.

To this end, the number of the second engagement protrusions 518 may be smaller than the number of the first engagement protrusions 514 and 515.

The second engagement protrusions 518 may be spaced apart in the vertical and horizontal directions from the first engagement protrusions 514 and 515, respectively.

In one example, the second engagement protrusion 518 may be located in a region corresponding to a region between a pair of the first engagement protrusions 514 and 515.

The horizontal distance of the second engagement protrusion 518 and the frame body 511 may be smaller than the horizontal distance of the first engagement protrusion 514 and 515 and the frame body 511. The present disclosure is not limited to the above-described configuration.

Further, the second engagement protrusion 518 may be connected to the frame body 511 via one or more of the connection ribs 518*a*. However, since the second engagement protrusion 518 is located close to the frame body 511, a plurality of the connection ribs 518*a* may connect the frame body 511 and the second engagement protrusion 518 to prevent effectively deformation of the frame body 511.

In order to prevent the frame body 511 from being deformed by the engagement force of the second engagement protrusion 518, the protrusion length of the second engagement protrusion 518 may be longer than the protrusion length of the first engagement protrusion 514 and 515.

The heat sink 550 may include the heat-dissipation plate 553, the heat-dissipation pipe 552, and the heat-dissipation fin 551.

In one example, the heat-dissipation fin 551 may include a stack of the plurality of fins. The plurality of fins are spaced in the vertical direction.

The heat-dissipation plate 553 is formed in the form of a thin plate. The heat-dissipation plate 553 contacts the heat-dissipation fin 551.

The vertical length of the heat-dissipation plate 553 may be the same or similar to the stack height of the plurality of fins. The present disclosure is not limited to the above-described configuration.

The heat sink 530 may further include an element-contacting plate 554 for contacting the thermoelectric element 520. The area of the element-contacting plate 554 may be smaller than the area of the heat-dissipation plate 553.

The element-contacting plate 554 may be formed to have approximately the same size as the thermoelectric element 520. The element-contacting plate 554 may be positioned within the element mounting hole 571 formed in the thermal-insulating member 570.

The heat-dissipation plate 553 may be in contact with the high-temperature portion of the thermoelectric element 520 to conduct heat to the heat-dissipation pipe 552 and the plurality of heat-dissipation fins 551.

The heat-dissipation pipe 552 may be a heat pipe with a heat-transfer fluid contained therein. A portion of the heat-dissipation pipe 552 may be seated in the pipe-seated groove formed in the heat-dissipation plate 550, while the other portion thereof may be arranged to pass through the heat-dissipation fin 551. Thus, the heat-dissipation pipe 552 may be disposed approximately in the form of "U".

The thickness of the heat-dissipation plate 553 may be preferably thin in terms of heat conduction. The heat-dissipation pipe 552 preferably has a diameter of at least a predetermined size in order to secure a space for condensation and evaporation of the heat-transfer fluid therein.

Thus, the diameter of the heat-dissipation pipe 552 may be greater than the thickness of the heat-dissipation plate 553.

In the element contact portion 554, a groove 5542 for receiving the heat-dissipation pipe 552 may be formed, such that the element contacts portion 554 contacts the heat-dissipation plate 553 without interfering with the heat-dissipation pipe 552 seated within the heat-dissipation plate 553. The first pipe 552*a* may be seated in the groove 5542.

The plurality of the heat-dissipation pipes 552 may contact the heat-dissipation plate 553 and a plurality of the heat-dissipation fins 551. The present disclosure is not limited to the above-described configuration.

In a portion of the heat-dissipation pipe 552 that contacts the heat-dissipation plate 553, the heat-transfer fluid inside the heat-dissipation pipe 552 may evaporate therein. In a portion of the pipe 552 in contact with the heat-dissipation fin 551, the heat-transfer fluid may be condensed therein.

The heat-transfer fluid may circulate in the heat-dissipation pipe 552 by density difference and/or gravity. Thus, the heat-transfer fluid may conduct heat from the heat-dissipation plate 553 to the heat-dissipation fin 551.

The heat-dissipation fin 551 may be located behind the middle plate 150. The heat-dissipation fin 551 may be located between the middle plate 150 and the rear panel 160. The heat-dissipation fin 551 may heat-dissipate by exchanging heat with the external air sucked by the heat-dissipation fan 590.

The heat-dissipation fan 590 may be disposed to face the heat sink 550. The heat-dissipation fan 590 may blow the outside air into the heat sink 550.

The heat-dissipation fan 590 may include a fan 592 and a shroud 593 surrounding the outside of the fan 592. In one example, the fan 592 may be an axial flow fan.

The heat-dissipation fan 590 may be spaced apart from the heat sink 550. Thereby, the flow resistance of the air blown by the heat-dissipation fan 590 may be minimized, and, further, the heat exchange efficiency at the heat sink 550 may be increased.

The heat-dissipation fan 590 may be secured to the heat sink 550 by fixing pins 580. In one example, the fixing pins 580 may be coupled to the plurality of fins. In one example, the fixing pins 580 may be coupled to the plurality of heat-dissipation fins 551.

The fixing pins 580 may penetrate the shroud 593. While the shroud 593 is combined with the fixing pins 580, the shroud 593 may be separated from the heat-dissipation fin 551.

The fixing pins 580 may be formed of a low thermal conductivity material such as rubber or silicone. Thus, since the heat-dissipation fan 590 is coupled to the fixing pins 580, the vibration generated in the rotation process of the fan 592 may be minimally transferred to the heat sink 550.

Figure 12:
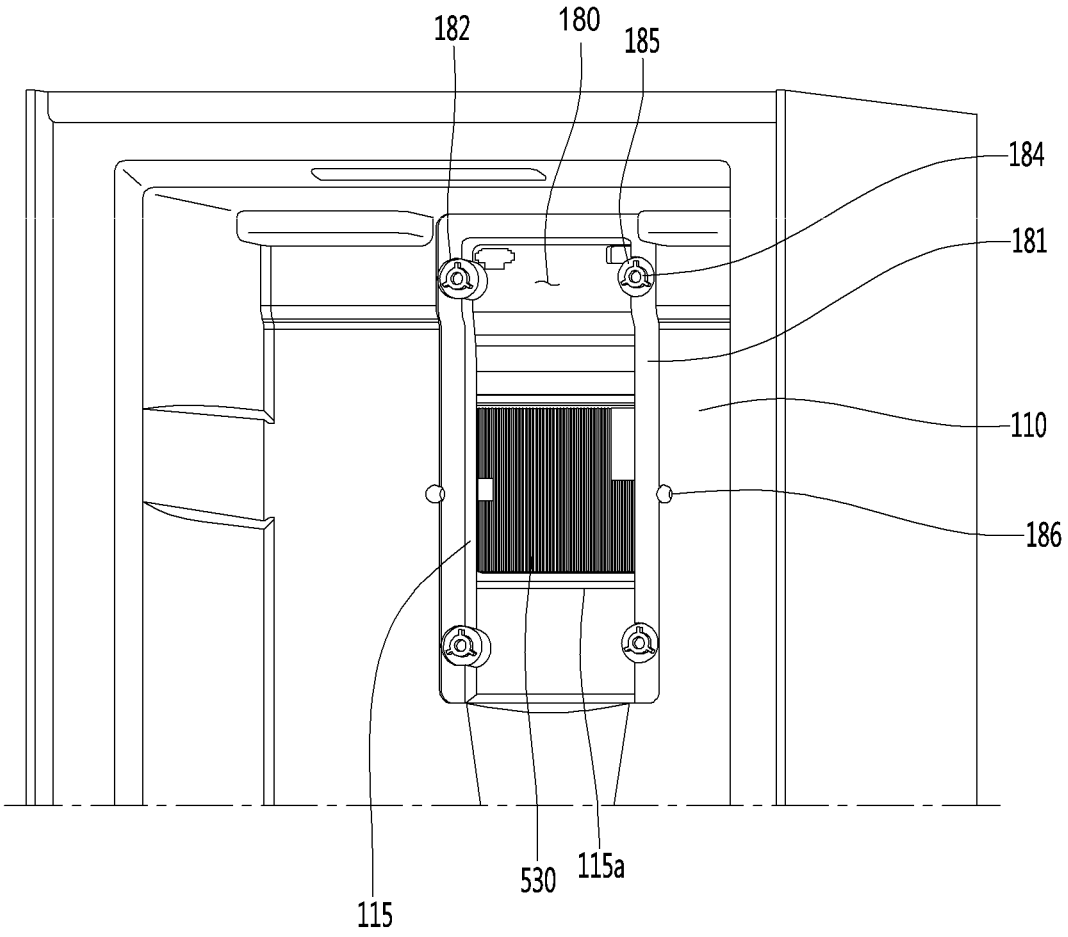
FIG. 12 illustrates an internal structure of an inner casing according to one embodiment of the present disclosure.
Figure 13:
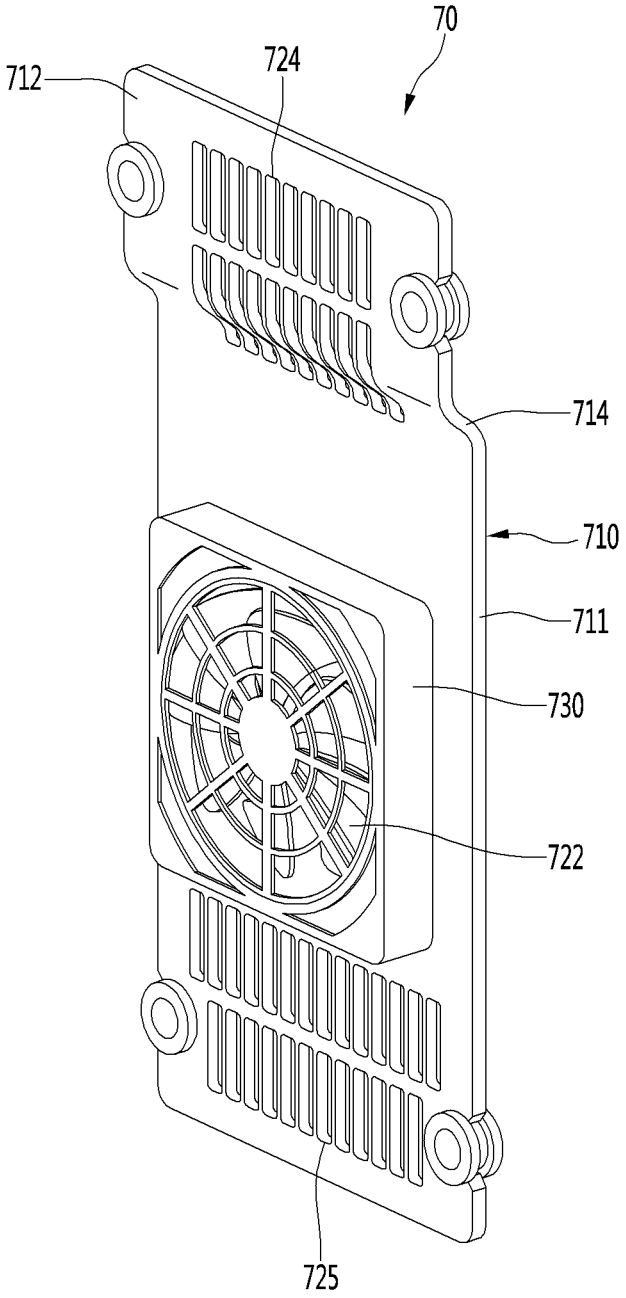
FIG. 13 and FIG. 14 are perspective views of a fan assembly according to one embodiment of the present disclosure.
Figure 14:
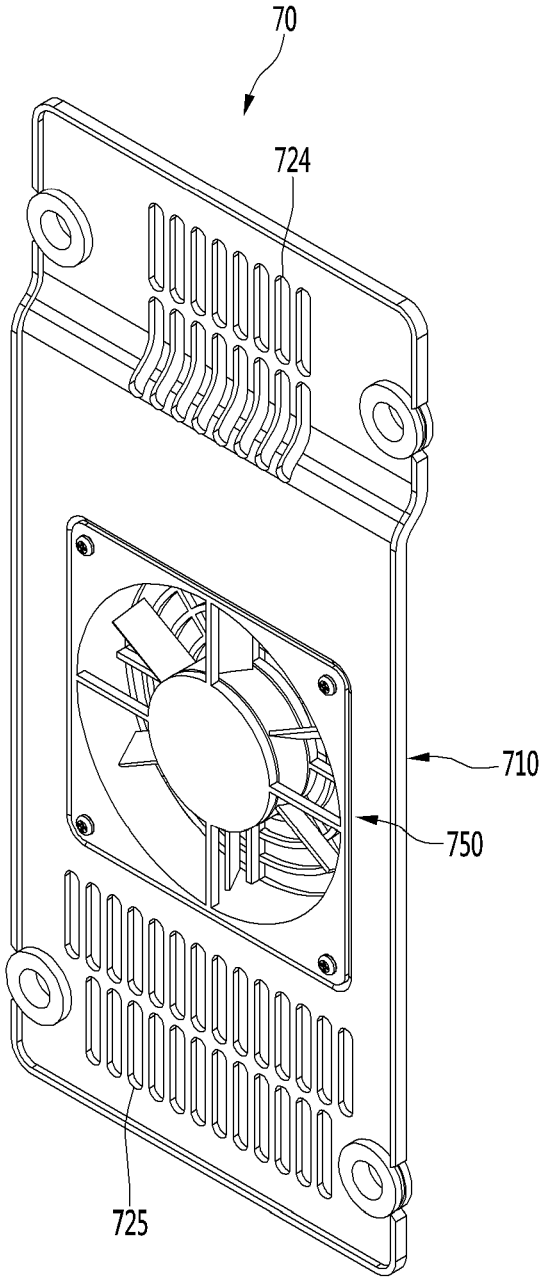
Figure 15:
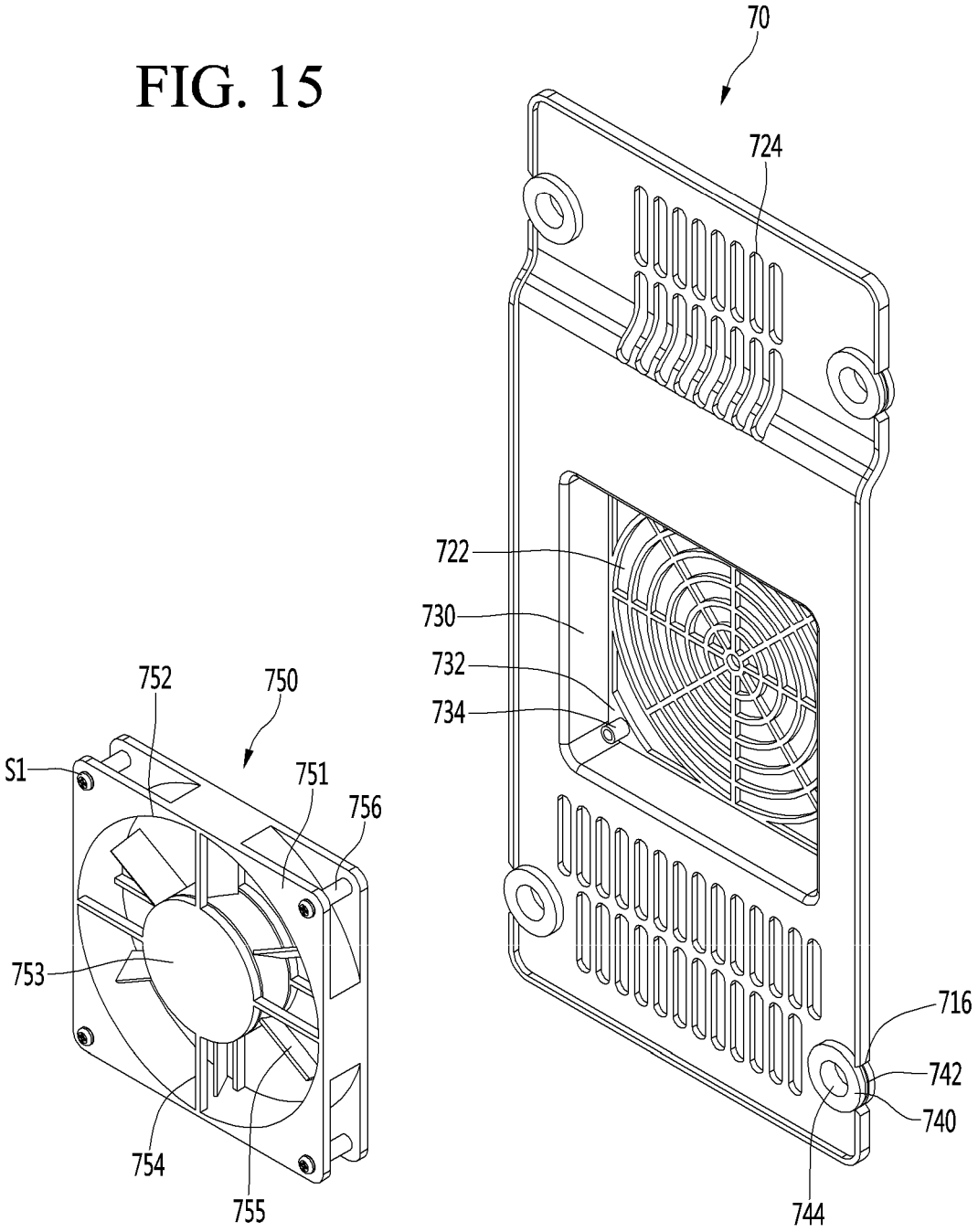
FIG. 15 is an exploded perspective view of the fan assembly of FIG. 14.
Figure 16:
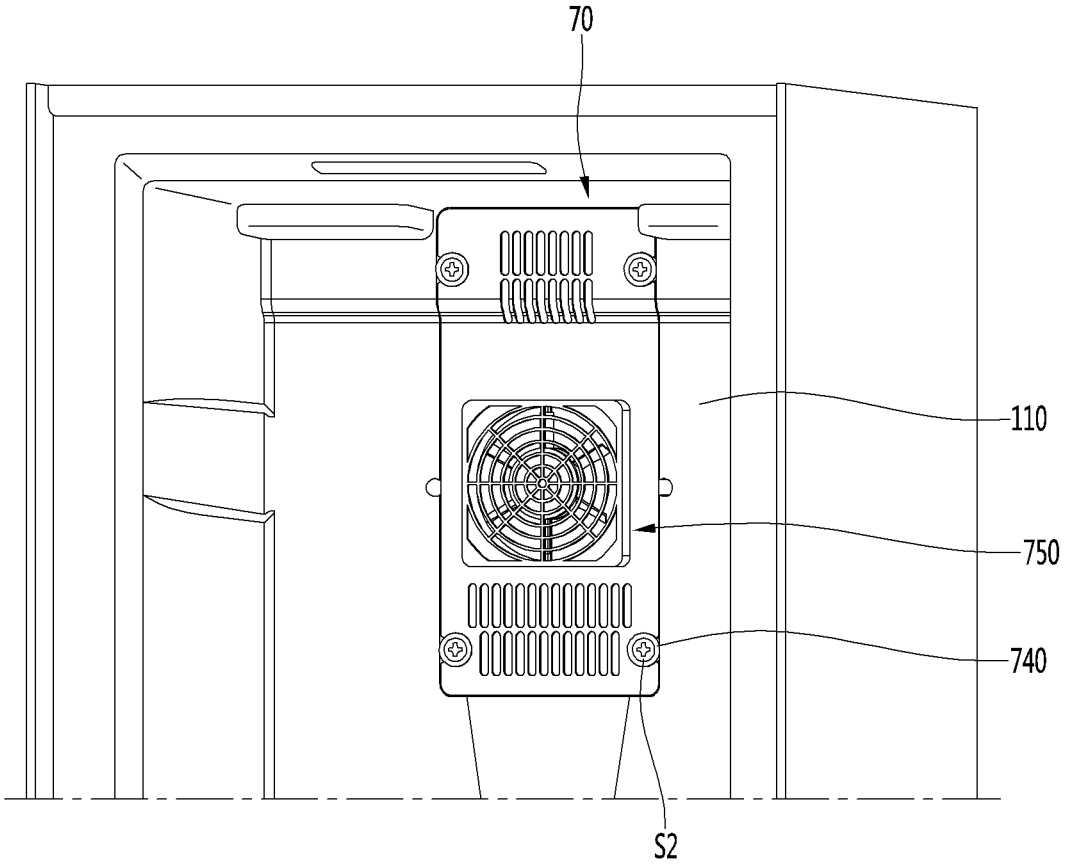
FIG. 16 is a view showing a state in which the fan assembly according to one embodiment of the present disclosure is installed in the inner casing.

FIG. 12 illustrates an internal structure of an inner casing according to one embodiment of the present disclosure. FIG. 13 and FIG. 14 are perspective views of a fan assembly according to one embodiment of the present disclosure. FIG. 15 is an exploded perspective view of the fan assembly of FIG. 14. FIG. 16 is a view showing a state in which the fan assembly according to one embodiment of the present disclosure is installed in the inner casing.

Referring to FIGS. 12 to 16, the fan assembly 70 according to the present embodiment may be installed on the inner casing 110 within the storage chamber 111.

The inner casing 110 may include a passage forming portion 115 to form the cooling passage 180. The passage forming portion 115 may be formed on the rear surface of the inner casing 110. In one example, the passage forming portion 115 may be formed by a part of the rear surface of the inner casing 110 being recessed backwardly. Accordingly, the passage forming portion 115 may protrude rearward from the rear surface of the inner casing 110. Further, an end of the passage forming portion 115 may be in contact with the installation bracket 60.

Accordingly, the foam liquid to be filled in the process of forming the thermal-insulating material may be located outside the passage forming portion 115 and may not be introduced into the passage forming portion 115. Thus, this may allow installing the cooling device onto the installation bracket 60 after the thermal-insulating material has been formed.

The passage forming portion 115 may be formed with an opening 115*a* through which the cooling sink 530 passes.

A receiving groove 181 for receiving the fan assembly 70 may be formed in the rear surface of the inner casing 110. The receiving groove 181 may be recessed rearward from the rear surface of the inner casing 110.

The receiving groove 181 may further include an additional groove 182 for receiving a shock-absorbing member 740 provided in the fan assembly 70. The additional groove 182 may be provided with an engagement boss 184 to couple to the shock-absorbing member 740 of the fan assembly 70. The engagement boss 184 may protrude from the additional groove 182. Further, the additional groove 182 may be provided with a plurality of reinforcement ribs 185 arranged along the engagement boss 184.

In addition, an engagement groove 186 may be formed in the rear surface of the inner casing 110 to receive the fastener for engagement with the second engagement portion 623 and the second engagement protrusion 518. Thus, the fastener may pass through the engagement groove 186 and engage the second engagement portion 623 and the second engagement protrusion 518. Further, the fastener engaged in the second engagement portion 623 and the second engagement protrusion 518 is received in the engagement groove 186. Thereby, the fastener is prevented from protruding into the storage chamber 111.

The fan assembly 70 may include a fan cover 710 and a cooling fan 750 installed in the fan cover 710.

The fan cover 710 may include a first cover body 711, a second cover body 712 spaced from the first cover body 711 in the front-rear direction, and an inclined or rounded connection body 714 connecting the first cover body 711 and the second cover body 712.

In one example, the second cover body 712 is located more frontwards than the first cover body 711. In other words, the second cover body 712 is located closer to the door 20 than the first cover body 711. Thus, the shape thereof may correspond to the shape of the inner casing 110. It is also possible that the fan cover 710 is composed of a single flat cover body according to the shape change of the inner casing 110.

The first cover body 711 may include a fan installation portion 730 for receiving the cooling fan 750. The fan installation portion 730 may protrude forward from the first cover body 711. In one example, as a part of the first cover body 711 protrudes forward, the fan installation portion 730 may be formed. Further, the cooling fan 750 may be located within the space formed by the fan installation portion 730.

The fan installation portion 730 may include a suction portion 732 having an inner suction hole 722. The suction portion 732 may prevent the user from accessing the cooling fan 750.

In the suction portion 732, an installation protrusion 734 for the installation of the cooling fan 750 may be formed.

The fan cover 710 may further include inner discharge holes 724 and 725.

The inner discharge holes 724 and 725 may include an upper discharge hole 724 and a lower discharge hole 725. The upper discharge hole 724 may be located above the inner suction hole 722, while the lower discharge hole 725 may be located under the inner suction hole 722. The configuration allows the temperature distribution of the storage chamber 111 to be uniform.

The area of the upper discharge hole 724 and the area of the lower discharge hole 726 may be the same or similar.

In one example, the lower discharge hole 725 may be located in the first cover body 711, while the upper discharge hole 724 may be located in the second cover body 712 and the connection body 714. Alternatively, it is also possible that the upper discharge hole 724 is present only in the second cover body 712.

The distance between the top of the lower discharge hole 725 and the bottom of the inner suction hole 722 may be smaller than the distance between the bottom of the upper discharge hole 724 and the top of the inner suction hole 722.

That is, the inner suction hole 722 may be located closer to the lower discharge hole 546 than the upper discharge hole 724.

In one embodiment, the cooling fan 750 may include a fan 755 and a shroud 751 on which the fan 755 is installed. The shroud 751 may include a fan receiving portion 752 that houses the fan 755. The fan receiving portion 752 may have a motor supporter 753 for supporting a motor (not shown) for rotation of the fan 755. The motor supporter 753 may be connected to the shroud 751 via a connection rib 754.

The shroud 751 may have a protrusion through-hole 756 through which the engagement protrusion 734 of the fan installation portion 730 passes. Thus, when the cooling fan 750 is received within the fan installation portion 730, the engagement protrusion 734 passes through the protrusion through-hole 756. In this state, a screw S1 may be engaged with the engagement protrusion 734.

A shock-absorbing member 740 may be coupled to the fan cover 710. A plurality of shock-absorbing members 740 may be coupled to each of both opposite sides of the fan cover 710.

The shock-absorbing member 740 may be formed in a ring shape having a hollow portion 744. Further, a slot 742 may be formed in the circumferential direction of the shock-absorbing member 740. In the fan cover 710, a space (not shown) for fitting the shock-absorbing member 740 therein may be formed. The fan cover 710 may be provided with an inserted portion 716 protruding into the space and inserted into the slot 742.

The thickness of the shock-absorbing member 740 may be greater than the thickness of the fan cover 710. Thus, when the shock-absorbing member 740 is coupled to the fan cover 710, the shock-absorbing member 740 may protrude from the front surface and the rear surface of the fan cover 710, respectively.

Hereinafter, the assembly process between the cooling device and the fan assembly will be described.

The order of assembly of the cooling device and the fan assembly is not limited. In one example, the process of assembling the fan assembly is described first.

To assemble the fan assembly 70, the cooling fan 750 may be first assembled with the fan cover 710. Further, the shock-absorbing member 740 may be coupled to the fan-cover 710.

Further, the fan assembly 70 is seated in the receiving groove 181 of the inner casing 110 in the storage chamber 111. In one example, the edge of the fan cover 710 may be seated within the receiving groove 181. Once the fan cover 710 is seated in the receiving groove 181, the engagement boss 184 located within the receiving groove 181 may be inserted into the hollow portion 744 of the shock-absorbing member 740. In this state, when the screw S2 is engaged with the engagement boss 184, the assembly of the fan assembly 70 may be completed.

In this connection, the cooling fan 740 may be positioned to be spaced forwardly from the opening 115*a* of the passage forming portion 115 in a state which the fan assembly 70 is assembled.

Next, the cooling device 50 may be assembled to install the cooling device 50 on the installation bracket 60.

The cooling device 50 may be installed on the installation bracket 60 from the rear of the installation bracket 60.

Then, after aligning the cooling sink 530 of the cooling device 50 with the receiving portion 611 of the installation bracket 60, the cooling sink 530 passes through the opening 612 of the receiving portion 611.

The cooling sink 530 passing through the opening 612 of the receiving portion 611 may be positioned within the cooling passage 180 through the opening 115*a* of the passage forming portion 115. The cooling sink 530 may be arranged to face the cooling fan 750 on the cooling passage 180. Thus, the air that has flowed into the cooling passage 180 through the inner suction hole 522 is heat-exchanged with the cooling sink 530 and thereafter flows in an upward direction and a downward direction. Then, the air may be supplied back into the storage chamber 111 through the inner discharge holes 524 and 525.

The first engagement protrusions 514 and 515 of the module frame 510 may be received respectively in the first protrusion receiving grooves 621 and 622 of the installation bracket 60. The second engagement protrusion 518 may be received within the second protrusion receiving groove 624. Further, the connection rib 516 of the module frame 510 may be received in the rib receiving groove 625 of the installation bracket 60.

In this state, from the rear of the cooling device 50, the fastener engages the first engagement protrusions 514 and 515 and the first engagement portion 621*a*, 622*a*. While the assembly of the cooling device 50 is completed, the fastener is passed from the storage chamber 111 through the engagement groove 186 of the inner casing 110, such that the fastener may be engaged with the second engagement portion 523 and the second engagement protrusion.

According to the proposed embodiment, the passage forming portion of the inner casing contacts the installation bracket, the cooling device is installed on the installation bracket, and the cooling sink is inserted into the passage forming portion. Thus, after the thermal-insulating material is formed, the cooling device may be installed without interfering with the thermal-insulating material.

In addition, in the frame body accommodating the thermoelectric element, the engagement protrusion in which the fastener is engaged is disposed at a position as far as possible from the frame body. Thus, in the process of engaging the fastener with the engagement protrusion, the frame body may be prevented from being deformed.

Preventing deformation of the frame body may allow the gasket provided on the frame body to be prevented from being separated from the bottom of the receiving portion of the installation bracket. Thus, the cooling passage and the heat-dissipation passage may be prevented from communicating with each other.

In addition, on the storage chamber, the fastener engages the inner casing with the installation bracket and the module frame. Thus, the contact force between the gasket and the bottom of the receiving portion may be increased.

What is claimed is:

1. A refrigerator comprising:

an inner casing that defines a storage chamber therein;

a passage forming portion that is provided on the inner casing and that defines a cooling passage;

a middle plate disposed outside the inner casing, wherein a foam space is defined between the middle plate and the inner casing and is configured to accommodate a thermal-insulating material;

an installation bracket fixed to the middle plate and configured to contact an end of the passage forming portion;

a thermoelectric module mounted on the installation bracket and disposed outside the foam space, wherein the thermoelectric module comprises a thermoelectric element; and a fan assembly that is arranged in the storage chamber of the inner casing and that comprises a cooling fan, wherein the installation bracket comprises:

an installation plate that defines a receiving portion that receives a portion of the thermoelectric module, the installation plate having a first surface that is in contact with the middle plate and a second surface that is opposite to the first surface, an engagement boss that protrudes from the second surface of the installation plate and is coupled to the middle plate, a plurality of first engagement portions that protrude from the second surface of the installation plate and are coupled to the thermoelectric module, and a second engagement portion that protrudes from the second surface of the installation plate and is coupled to the inner casing, and wherein the inner casing comprises a plate engagement boss that is aligned with the second engagement portion.

2. The refrigerator of claim 1, wherein the thermoelectric module further comprises:

a module frame;

a cooling sink configured to be received in the module frame so as to be in contact with the thermoelectric element; and a heat sink positioned opposite the cooling sink with respect to the thermoelectric element, and wherein the module frame is configured to be coupled to the installation bracket.

3. The refrigerator of claim 2, wherein the module frame of the thermoelectric module comprises:

a frame body having a space in which the thermoelectric element is disposed; and an engagement plate extending from the frame body, and wherein the engagement plate has at least one first engagement protrusion that is configured to engage with the installation bracket and that is spaced apart from the frame body.

4. The refrigerator of claim 3, wherein the receiving portion receives the frame body of the module frame of the thermoelectric module, and wherein the frame body is configured to couple with a gasket to contact a bottom of the receiving portion of the installation bracket.

5. The refrigerator of claim 3, wherein the at least one first engagement protrusion of the engagement plate of the module frame of the thermoelectric module is positioned in the engagement plate at a first location that maximizes a straight-line distance from the frame body of the module frame.

6. The refrigerator of claim 4, further comprising a connection rib that is configured to connect the at least one first engagement protrusion of the engagement plate of the module frame with the frame body of the module frame.

7. The refrigerator of claim 6, wherein the installation bracket has (i) at least one first protrusion receiving groove that is configured to receive the at least one first engagement protrusion of the engagement plate of the module frame, and (ii) a rib receiving groove that is configured to receive the connection rib.

8. The refrigerator of claim 3, wherein the engagement plate of the module frame of the thermoelectric module has at least one second engagement protrusion that is configured to engage with the inner casing and with the installation bracket via a fastener.

9. The refrigerator of claim 8, wherein the at least one second engagement protrusion of the engagement plate of the module frame is spaced apart from the frame body of the module frame, and wherein a distance between the at least one second engagement protrusion and the frame body is smaller than a distance between the at least one first engagement protrusion and the frame body.

10. The refrigerator of claim 9, wherein the at least one first engagement protrusion of the engagement plate of the module frame of the thermoelectric module comprises a plurality of first engagement protrusions, wherein a number of the at least one second engagement protrusion is smaller than a number of the plurality of first engagement protrusions, and wherein the at least one second engagement protrusion is positioned in a region between the plurality of the first engagement protrusions.

11. The refrigerator of claim 9, wherein the at least one second engagement protrusion of the engagement plate of the module frame of the thermoelectric module is configured to be connected to the frame body of the module frame via a plurality of connection ribs.

12. The refrigerator of claim 9, wherein a protrusion length of the at least one second engagement protrusion is greater than a protrusion length of the at least one first engagement protrusion.

13. The refrigerator of claim 8, wherein the installation bracket further comprises at least one second protrusion receiving groove that is configured to accommodate the at least one second engagement protrusion of the engagement plate of the module frame of the thermoelectric module.

14. The refrigerator of claim 2, wherein the fan assembly comprises a fan cover having a fan installation portion that is configured to receive the cooling fan, and wherein the fan cover is arranged on the inner casing within the storage chamber in a state in which the cooling fan is received in the fan installation portion.

15. The refrigerator of claim 14, wherein an opening is defined in the passage forming portion, and wherein the cooling sink in the thermoelectric module is configured to be received into the cooling passage through the opening, and positioned within the cooling passage so as to face the cooling fan.

16. The refrigerator of claim 14, further comprising a shock-absorber that is configured to couple to the fan cover, wherein the inner casing has a receiving groove that is configured to receive the fan cover, wherein the receiving groove of the inner casing has an additional groove that is configured to accommodate the shock-absorber, wherein the additional groove has an additional engagement boss that is configured to secure the shock-absorber, and wherein the additional engagement boss is configured to engage with a fastener from a front of the fan cover.

17. The refrigerator of claim 16, wherein the additional groove comprises a plurality of reinforcement ribs that are arranged along a circumference of the additional engagement boss.

18. The refrigerator of claim 14, wherein the fan cover comprises (i) a first cover body, (ii) a second cover body that is spaced in a front direction and a back direction from the first cover body, and (iii) an inclined or rounded connection body that is configured to connect the first cover body and the second cover body, wherein the second cover body is located further towards the front direction than the first cover body, and wherein the fan assembly is disposed in the first cover body.

19. The refrigerator of claim 1, wherein the second engagement portion is disposed between the plurality of first engagement portions.

20. The refrigerator of claim 1, wherein the engagement boss, the plurality of first engagement portions, and the second engagement portion are arranged along a periphery of the receiving portion and connected to the second surface of the installation plate.

* * * * *